US011959159B2

(12) United States Patent
Kim et al.

(10) Patent No.: US 11,959,159 B2
(45) Date of Patent: Apr. 16, 2024

(54) AUSTENITIC STAINLESS STEEL HAVING EXCELLENT PIPE-EXPANDABILITY AND AGE CRACKING RESISTANCE

(71) Applicant: POSCO, Pohang-si (KR)

(72) Inventors: Sang Seok Kim, Pohang-si (KR); Deok Chan Ahn, Seoul (KR); Mi-Nam Park, Pohang-si (KR); Hyun Woong Min, Yongin-si (KR); Yung Min Kim, Pohang-si (KR)

(73) Assignee: POSCO CO., LTD, Pohang-si (KR)

( * ) Notice: Subject to any disclaimer, the term of this patent is extended or adjusted under 35 U.S.C. 154(b) by 535 days.

(21) Appl. No.: 17/275,408

(22) PCT Filed: Aug. 22, 2019

(86) PCT No.: PCT/KR2019/010718
§ 371 (c)(1),
(2) Date: Mar. 11, 2021

(87) PCT Pub. No.: WO2020/054999
PCT Pub. Date: Mar. 19, 2020

(65) Prior Publication Data

US 2022/0049333 A1 Feb. 17, 2022

(30) Foreign Application Priority Data

Sep. 13, 2018 (KR) ..... 10-2018-0109790

(51) Int. Cl.
*C22C 38/58* (2006.01)
*C21D 6/00* (2006.01)
(Continued)

(52) U.S. Cl.
CPC ..... *C22C 38/58* (2013.01); *C21D 6/004* (2013.01); *C21D 8/105* (2013.01); *C21D 9/08* (2013.01);
(Continued)

(58) Field of Classification Search
CPC .... C21D 2211/001; C21D 6/00; C21D 6/004; C21D 6/005; C21D 6/008; C21D 8/02;
(Continued)

(56) References Cited

U.S. PATENT DOCUMENTS

2003/0099567 A1 5/2003 Suzuki et al.
2005/0232805 A1 10/2005 Takeda et al.
2012/0034126 A1 2/2012 Nylof et al.

FOREIGN PATENT DOCUMENTS

CN 101994068 A 3/2011
CN 112805398 B 9/2022
(Continued)

OTHER PUBLICATIONS

Chinese Office Action dated Sep. 14, 2021 issued in Chinese Patent Application No. 201980066354.7 (with English translation ).
(Continued)

*Primary Examiner* — Jenny R Wu
(74) *Attorney, Agent, or Firm* — Morgan, Lewis & Bockius LLP

(57) ABSTRACT

The austenitic stainless steel that does not cause defects such as aging crack or delayed fracture even after the expansion and curling process of 5 steps or more is disclosed. In accordance with an aspect of the present disclosure, an austenitic stainless steel with excellent pipe expanding workability and aging crack resistance includes, in percent (%) by weight of the entire composition, C: 0.01 to 0.04%, Si: 0.1 to 1.0%, Mn: 0.1 to 2.0%, Cr: 16 to 20%, Ni: 6 to 10%, Cu: 0.1 to 2.0%, Mo: 0.2% or less, N: 0.035 to 0.07%, the remainder of iron (Fe) and other inevitable impurities, and the C+N satisfies 0.1% or less, the product of the Md30 (° C.) value and average grain size (μm) satisfies less than −500.

1 Claim, 4 Drawing Sheets

(51) Int. Cl.

| | |
|---|---|
| ***C21D 8/10*** | (2006.01) |
| ***C21D 9/08*** | (2006.01) |
| ***C22C 38/00*** | (2006.01) |
| ***C22C 38/02*** | (2006.01) |
| ***C22C 38/04*** | (2006.01) |
| ***C22C 38/42*** | (2006.01) |
| ***C22C 38/44*** | (2006.01) |

(52) U.S. Cl.
CPC ..... *C22C 38/001* (2013.01); *C22C 38/02* (2013.01); *C22C 38/04* (2013.01); *C22C 38/42* (2013.01); *C22C 38/44* (2013.01); *C21D 2211/001* (2013.01)

(58) Field of Classification Search
CPC .. C21D 8/0205; C21D 8/0226; C21D 8/0236; C21D 8/0273; C21D 8/105; C21D 9/08; C21D 9/46; C22C 38/00; C22C 38/001; C22C 38/02; C22C 38/04; C22C 38/42; C22C 38/44; C22C 38/58
See application file for complete search history.

(56) References Cited

FOREIGN PATENT DOCUMENTS

| | | | | |
|---|---|---|---|---|
| JP | H07197199 | A | | 8/1995 |
| JP | H08120419 | A | | 5/1996 |
| JP | 08283915 | A | * | 10/1996 |
| JP | H08-260111 | A | | 10/1996 |
| JP | H08-283915 | A | | 10/1996 |
| JP | 09310155 | A | * | 12/1997 |
| JP | H09-310155 | A | | 12/1997 |
| JP | 2002371339 | A | | 12/2002 |
| JP | 2003-129188 | A | | 5/2003 |
| JP | 3827986 | B2 | | 9/2006 |
| JP | 2009-299171 | A | | 12/2009 |
| JP | 2016-065296 | A | | 4/2016 |
| KR | 10-2003-0050211 | A | | 6/2003 |
| KR | 10-2014-0131214 | A | | 11/2014 |
| KR | 10-2017-0056007 | A | | 5/2017 |

OTHER PUBLICATIONS

Chinese Office Action dated Mar. 22, 2022 issued in Chinese Patent Application No. 201980066354.7 (with English translation ).
Y. Kang, "Theory and Technology of Processing and Forming for Advanced Automobile Steel Sheets," Feb. 28, 2009.
Japanese Office Action dated Apr. 5, 2022 issued in Japanese Patent Application No. 2021-513967 (with English translation).
Extended European Search Report dated Jun. 14, 2021 issued in European Patent Application No. 19860388.8.
Office Action issued in Korean Patent Application No. 10-2018-0109790 dated Mar. 5, 2020.
International Search Report and Written Opinion issued in International Application No. PCT/KR2019/010718 dated Dec. 20, 2019.
Office Action issued in corresponding Vietnamese Application No. 1-2021-01318 dated Aug. 14, 2023, with English translation.

* cited by examiner

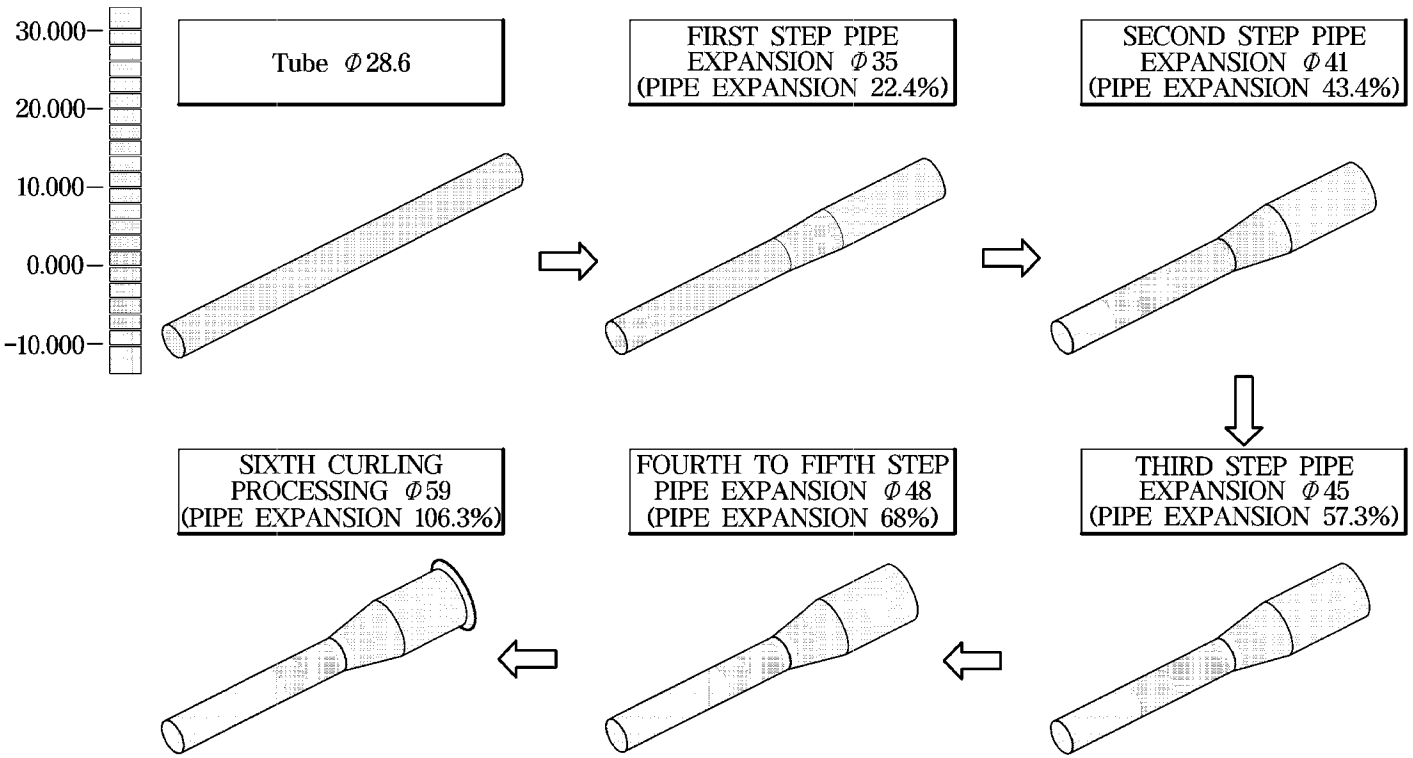
【FIGURE 1】

【FIGURE 2】
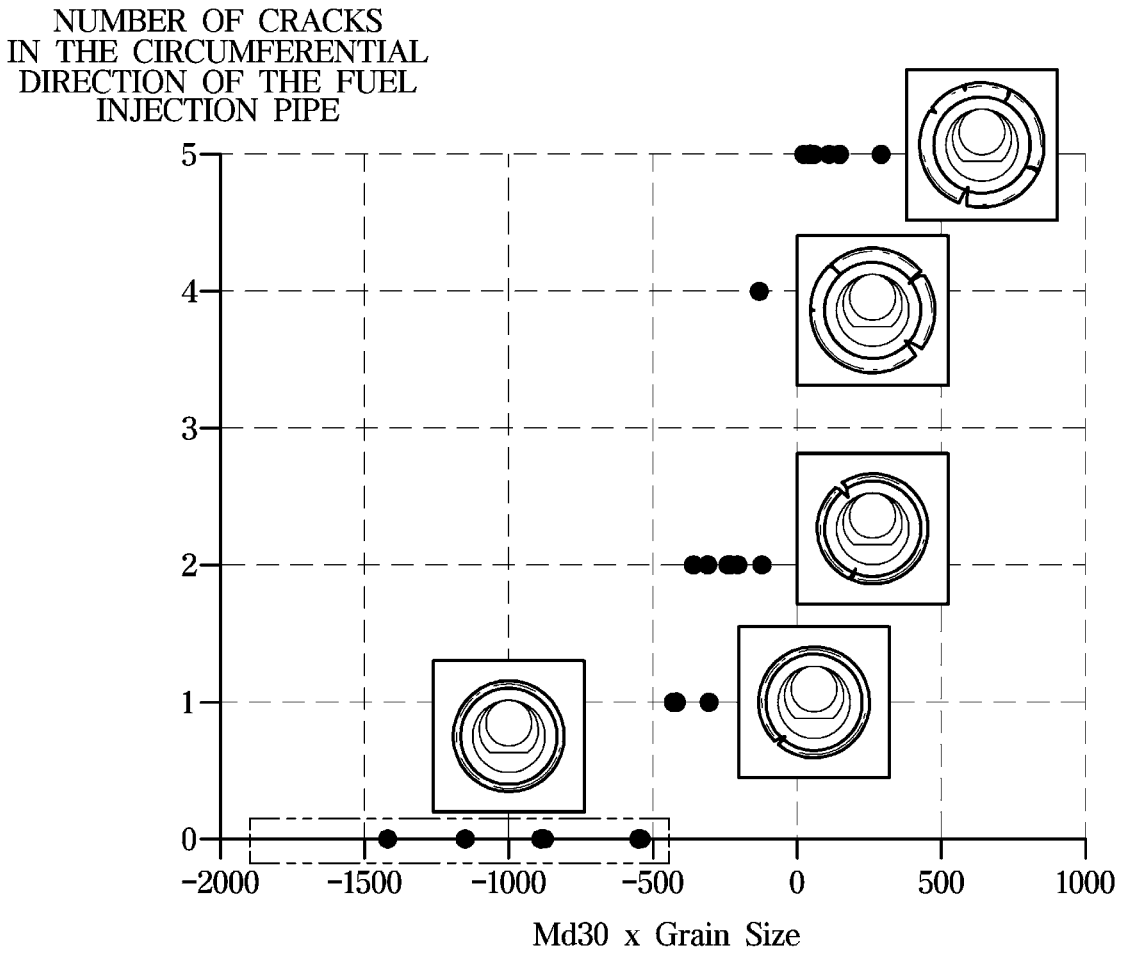

【FIGURE 3】
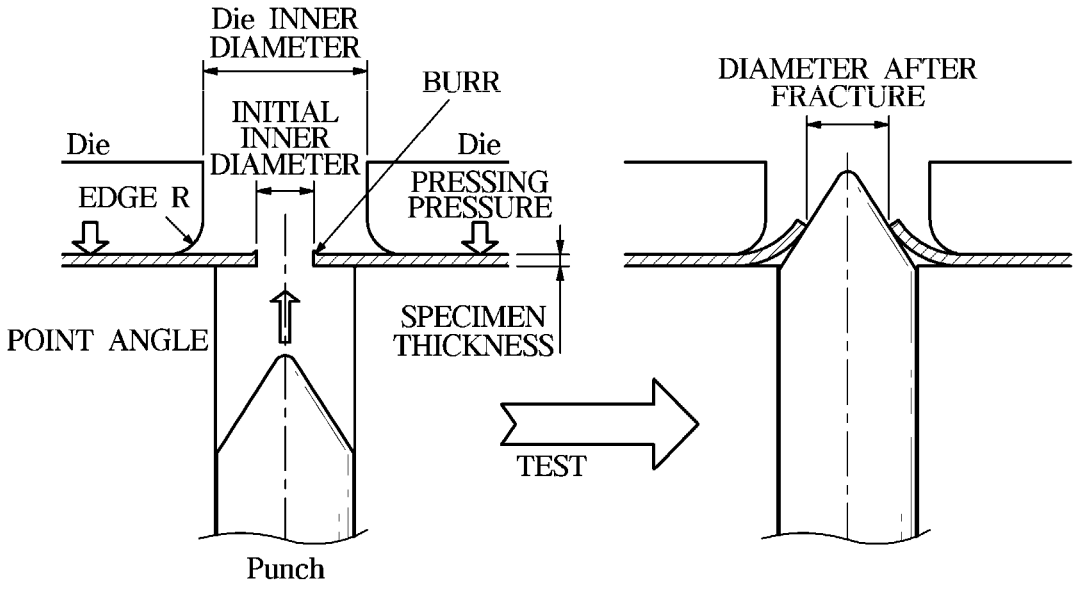

【FIGURE 4】
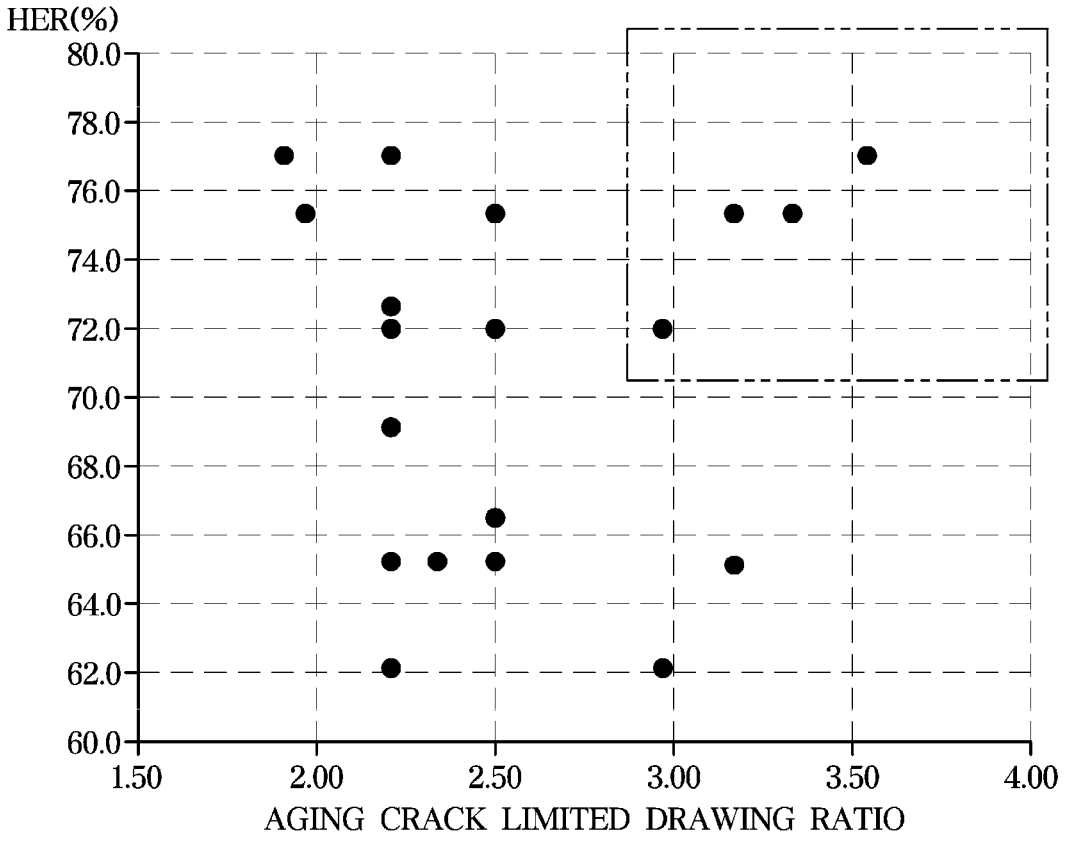

AUSTENITIC STAINLESS STEEL HAVING EXCELLENT PIPE-EXPANDABILITY AND AGE CRACKING RESISTANCE

CROSS-REFERENCE OF RELATED APPLICATIONS

This application is the U.S. National Phase under 35 U.S.C. § 371 of International Patent Application No. PCT/KR2019/010718, filed on Aug. 22, 2019, which claims the benefit of Korean Patent Application No. 10-2018-0109790, filed on Sep. 13, 2018, the entire disclosures of each are incorporated by reference herein.

TECHNICAL FIELD

The present disclosure relates to an austenitic stainless steel with excellent pipe expanding workability, and more specifically, austenitic stainless steel with excellent pipe expanding workability and aging crack resistance, which does not cause defects such as aging crack or delayed fracture even after the expansion and curling process of more than 5 steps.

BACKGROUND ART

Recently, automobile fuel injection pipes are being converted to stainless steel, which has superior corrosion resistance and high strength compared to carbon steel for lighter weight and high function. Generally, after making a 1.2 mm carbon steel tube, it passes through the painting and coating process to prevent rust, but stainless steel has the advantage of omitting the painting and coating process due to its excellent corrosion resistance.

However, because automobile fuel injection pipes go through complex processing steps such as the expansion process of 5 to 6 steps and the final curling process, the application of ferritic stainless steel or duplex stainless steel with poor workability is not easy, and application of austenitic stainless steel with excellent workability is being considered. In particular, automobile manufacturers are hoping to develop stainless steel for fuel injection pipes within the range that satisfies the 304 component standards (KS, JIS, ASTM), so it is required to develop austenitic stainless steel that satisfies 304 material standards (EN, KS) of yield strength of 230 MPa or more and tensile strength of 550 MPa or more and does not crack even in complex processing of fuel injection pipes.

Patent Document 1 describes an oil pipe, characterized in that it is made of a pipe made of austenitic stainless steel with a work-hardening exponent (n value) of 0.49 or less. However, the material characteristics of cold-rolled products with a work-hardening exponent (n value) of 0.49 or less suggested in Patent Document 1 are difficult to apply simply to the molding of automobile fuel injection pipes that are becoming diverse and complex.

(Patent Document 0001) Korean Patent Application Publication No. 10-2003-0026330 (2003 Mar. 31.)

DISCLOSURE

Technical Problem

In order to solve the above-described problems, the present disclosure intends to provide a austenitic stainless steel with excellent pipe expanding workability and aging crack resistance that can prevent aging cracks even in processing of various and complex shapes and multi-stage expansion processing within the composition standard of 304 steel.

Technical Solution

In accordance with an aspect of the present disclosure, an austenitic stainless steel with excellent pipe expanding workability and aging crack resistance includes, in percent (%) by weight of the entire composition, C: 0.01 to 0.04%, Si: 0.1 to 1.0%, Mn: 0.1 to 2.0%, Cr: 16 to 20%, Ni: 6 to 10%, Cu: 0.1 to 2.0%, Mo: 0.2% or less, N: 0.035 to 0.07%, the remainder of iron (Fe) and other inevitable impurities, and the C+N satisfies 0.1% or less, the product of the Md30 (° C.) value represented by the following equation (1) and average grain size (μm) satisfies less than −500.

$$Md30=551-462*(C+N)-9.2*Si-8.1*Mn-13.7*Cr-29*(Ni+Cu)-18.5*Mo \quad (1)$$

Here, C, N, Si, Mn, Cr, Ni, Cu, Mo mean the content (% by weight) of each element.

The C+N may satisfy the range of 0.06 to 0.1%.

The work-hardening exponent n value in the range of true strain 0.3 to 0.4 may satisfy the range of 0.45 to 0.5.

The Md30 value in the above equation (1) may be −10° C. or less.

The average grain size may be 45 μm or more.

The aging crack limited drawing ratio of the stainless steel may be 2.97 or more.

The hole expansion rate (HER) represented by the following equation (2) may be 72% or more.

$$HER=(D_h-D_0)/D_0\times 100 \quad (2)$$

Here, $D_h$ is the inner diameter after fracture and $D_0$ is the initial inner diameter.

Advantageous Effects

The austenitic stainless steel according to the embodiment of the present disclosure has excellent pipe expanding workability with a hole expansion rate of 70% or more, and has excellent aging crack resistance with an aging crack limited drawing ratio of 2.9 or more, so circumferential cracks may not occur when forming automobile fuel injection pipes.

DESCRIPTION OF DRAWINGS

FIG. 1 is a diagram sequentially showing a process of forming a fuel injection pipe for a vehicle using a tube assembly.

FIG. 2 is a graph showing the correlation of the number of cracks in the circumferential direction of a fuel injection pipe according to Md30 (° C.)×grain size (μm).

FIG. 3 is a schematic diagram of a method for measuring a hole expansion rate.

FIG. 4 is a graph showing an aging crack limited drawing ratio and a hole expansion rate range according to an embodiment of the present disclosure.

MODES OF THE INVENTION

Hereinafter, the embodiments of the present disclosure will be described in detail with reference to the accompanying drawings. The following embodiments are provided to transfer the technical concepts of the present disclosure to one of ordinary skill in the art. However, the present disclosure is not limited to these embodiments, and may be embodied in another form. In the drawings, parts that are irrelevant to the descriptions may be not shown in order to clarify the present disclosure, and also, for easy understanding, the sizes of components are more or less exaggeratedly shown.

Recently, automobile fuel injection pipes are being converted to stainless steel with excellent corrosion resistance and high strength. However, since automobile fuel injection pipes undergo complex processing steps of 5 to 6 steps, circumferential cracks occur in the expansion process and the final curling process. Therefore, the present inventors have proposed a stainless steel having excellent expansion properties and excellent aging crack resistance so that cold-rolled products can be manufactured using an austenitic stainless steel plate for automotive fuel injection pipe use.

In the present disclosure, it was attempted to develop a steel material with excellent pipe expanding workability and aging crack resistance while securing material strength (yield strength of 230 MPa or more, tensile strength of 550 MPa or more) that satisfies the range of 304 material standard. It is not easy to simultaneously secure hole expansion and aging crack resistance required in the automobile fuel injection pipe molding process within the range that satisfies the 304 component standard and material standard. In general, 304 steel is a steel with Transformation Induced Plasticity (TRIP) characteristics, and is a steel grade used for sinks and western tableware by utilizing a high work-hardening exponent (n) of 0.5 or higher. However, 304 steel has a problem that aging cracks are caused when forming a fuel injection pipe due to the generation of a large amount of martensite caused by TRIP.

FIG. 1 is a diagram sequentially showing a process of forming a fuel injection pipe for a vehicle using a tube assembly.

Referring to FIG. 1, in the molding of a fuel injection pipe for a vehicle, one end of a tube having a diameter of 28.6 mm is expanded to about 50 mm in diameter over 4 to 5 steps, and for this purpose, an expansion rate of 70% or more is required. In addition, the fuel injection port that was finally expanded is molded to a diameter of 59 mm through the curling process, and the expansion rate exceeds 100%.

Like this, if general 304 steel is molded into fuel injection pipe as it is, a large number of aging cracks occur in the circumferential direction of the injection port of the fuel injection pipe because the required high expansion rate is not met. Therefore, in order to secure aging crack resistance, there is a method of managing the work-hardening exponent n value to 0.5 or less by lowering only the Md30 (° C.) value. However, due to the low hole expansion rate, there is a problem in that cracks occur in the expansion/curling processing steps of 5 to 6 steps as shown in FIG. 1. Therefore, in the present disclosure, the composition range and parameters of specific cold-rolled products that satisfy high pipe expanding workability and aging crack resistance at the same time are presented.

Austenitic stainless steel with excellent pipe expanding workability and aging crack resistance according to an embodiment of the present disclosure includes, in percent (%) by weight of the entire composition, C: 0.01 to 0.04%, Si: 0.1 to 1.0%, Mn: 0.1 to 2.0%, Cr: 16 To 20%, Ni: 6 to 10%, Cu: 0.1 to 2.0%, Mo: 0.2% or less, N: 0.035 to 0.07%, the remainder of iron (Fe) and other inevitable impurities.

Hereinafter, the reason for limiting the numerical value of the alloy element content in the embodiment of the present disclosure will be described. Hereinafter, unless otherwise specified, the unit is % by weight.

The content of C is 0.01 to 0.04%.

In the steel, C is an austenite phase stabilizing element, and the more it is added, the more effective the austenite phase is stabilized, so it is necessary to add 0.01% or more. However, if it contains more than 0.04%, it hardens the deformation induced martensite, causing aging cracks (season cracks) in severely deformed areas during molding.

The content of Si is 0.1 to 1.0%.

In the steel, Si is a component added as a deoxidizing agent in the steel making step, and when a certain amount is added, when going through the Bright Annealing process, Si-Oxide is formed in the passivation film to improve the corrosion resistance of the steel. However, when it contains more than 1.0%, there is a problem of lowering the ductility of the steel.

The content of Mn is 0.1 to 2.0%.

Among the steels, Mn is an austenite phase stabilizing element, the more it contains, the more the austenite phase is stabilized, and more than 0.1% is added. Excessive addition inhibits corrosion resistance, so it is limited to 2% or less.

The content of Cr is 16.0 to 20.0%.

Cr in steel is an essential element for improving corrosion resistance, and it is necessary to add 16.0% or more to secure corrosion resistance. Excessive addition hardens the material and adversely lowers the formability such as pipe expanding workability, so it is limited to 20.0%.

The content of Ni is 6.0 to 10.0%.

Nickel in steel is an austenite phase stabilizing element, and the more it is added, the more the austenite phase is stabilized to soften the material, and it is necessary to add 6.0% or more to suppress work hardening caused by the occurrence of deformation induced martensite. However, if expensive Ni is added excessively, a problem of cost increase occurs, and it is limited to 10.0%.

The content of Cu is 0.1 to 2.0%.

In the steel, Cu is an austenite phase stabilizing element, and as it is added, the austenite phase is stabilized and has an effect of suppressing work hardening caused by the occurrence of deformation induced martensite, so 0.1% or more is added. However, if it is added in excess of 2.0%, there is a problem of lowering corrosion resistance and an increase in cost.

The content of Mo is 0.2% or less.

In the steel, Mo has the effect of improving corrosion resistance and workability when added, but excessive addition leads to an increase in cost, so it is limited to 0.2% or less.

The content of N is 0.035 to 0.07%.

In the steel, N is an austenite phase stabilizing element, and the more it is added, the more effective it is to stabilize the austenite phase. In addition, it is necessary to add 0.035% or more to improve the strength of the material. However, if it contains more than 0.07%, it hardens the deformation induced martensite and causes aging cracks in the severely deformed area during molding.

In addition, according to an embodiment of the present disclosure, C+N may satisfy a range of 0.06 to 0.1%.

By controlling the content of C+N to 0.06% or more, austenitic stainless steel according to the present disclosure can exhibit a yield strength (YS) of 230 MPa or more and a tensile strength (TS) of 550 MPa or more, and satisfy the 304 material standard. If C+N exceeds 0.1%, the Md30 value and the work-hardening exponent n value are lowered, but the strength is too high and the material hardens, which increases the possibility of aging cracks.

In addition, for the austenitic stainless steel with excellent pipe expanding workability and aging crack resistance according to an embodiment of the present disclosure, the product of the Md30 (° C.) value and average grain size (μm) satisfies less than −500.

That is, [Md30(° C.)×Grain Size (μm)<−500] is satisfied, and Md30 is expressed as Equation (1) below.

$$Md30=551-462*(C+N)-9.2*Si-8.1*Mn-13.7*Cr-29*(Ni+Cu)-18.5*Mo-68*Nb \quad (1)$$

Equation (1) contains Nb, but the present disclosure does not aim to add Nb. Therefore, if Nb is not added, 0 is substituted for the corresponding Nb variable, and if the content is included as an impurity at a measurable level, the value can be substituted.

For example, the Md30 value of the austenitic stainless steel according to the present disclosure may be −10° C. or less, and the average grain size (GS) may be 45 μm or more.

In metastable austenitic stainless steel, martensitic transformation occurs by plastic working at a temperature above the martensitic transformation initiation temperature (Ms). The upper limit temperature that causes phase transformation by such processing is indicated by the Md value, and in particular, the temperature (° C.) at which 50% phase transformation to martensite occurs when 30% strain is applied is referred to as Md30. When the Md30 value is high, the strain-induced martensite phase is easily generated, whereas when the Md30 value is low, the strain-induced martensite phase is relatively difficult to form. This Md30 value is used as an index to determine the degree of austenite stabilization of ordinary metastable austenitic stainless steel.

The Md30 value affects the strain-induced martensite production as well as the work-hardening exponent. Accordingly, for austenitic stainless steel with excellent pipe expanding workability and aging crack resistance according to an embodiment of the present disclosure, a work-hardening exponent n value in the range of 0.3 to 0.4 of the true strain may satisfy the range of 0.45 to 0.5. Most of the 300 series austenitic stainless steel materials have a work-hardening exponent (n) in the range of 0.3 to 0.4 at a true strain of 10 to 20% at the beginning of deformation. However, most 300 series austenitic stainless steel materials have a work-hardening exponent of 0.55 or more at 30% or more of the true strain in the latter half of the deformation according to the austenite stability (Md30).

If the work-hardening exponent n value is less than 0.45, sufficient work hardening is not achieved and the elongation is rather lowered. If it exceeds 0.5, excessive work hardening may occur and aging cracks may be caused by strain-induced martensite phase transformation.

Accordingly, an aging crack limited drawing ratio of austenitic stainless steel according to an embodiment of the present disclosure may be 2.97 or more. The aging crack limited drawing ratio refers to the limited drawing ratio in which aging crack does not occur, and refers to the ratio (D/D') between the maximum diameter (D) of the material and the punch diameter (D') during drawing.

In the present disclosure, excellent pipe expanding workability and aging crack resistance can be secured by harmonizing the Md30 value, the average grain size and C+N content range of the final cold-rolled product and the cracks can be prevented even during expansion/curling molding for automobile fuel injection pipes.

In addition, according to an embodiment of the present disclosure, the hole expansion rate (HER) represented by Equation (2) below may be 72% or more.

$$HER=(D_h-D_0)/D_0\times 100 \quad (2)$$

Here, $D_h$ is the inner diameter after fracture, and $D_0$ is the initial inner diameter.

Hereinafter, it will be described in more detail through a preferred embodiment of the present disclosure.

Fuel Infection Pipe Molding-Crack Evaluation

Lab. vacuum melting was performed on a part of the austenitic stainless steel shown in Table 1 below to prepare an ingot, and a part was subjected to an electric furnace-VOD-continuous casting process to produce a slab. The prepared ingots and slabs were reheated at 1,240° C. for 1 to 2 hours, and then made of hot-rolled material by a rough rolling mill and a continuous finishing mill, and after hot rolling annealing at a temperature of 1,000 to 1,100° C., cold rolling and cold rolling annealing were performed.

TABLE 1

| | C | N | Si | Mn | Cr | Ni | Mo | Cu |
|---|---|---|---|---|---|---|---|---|
| Inventive Example1 | 0.02 | 0.04 | 0.3 | 1.5 | 18.3 | 8.3 | 0.1 | 1.2 |
| Inventive Example2 | 0.02 | 0.04 | 0.3 | 1.5 | 18.3 | 8.3 | 0.1 | 1.2 |
| Inventive Example3 | 0.056 | 0.04 | 0.39 | 1.01 | 18.1 | 8.07 | 0.101 | 0.82 |
| Inventive Example4 | 0.049 | 0.036 | 0.39 | 1.06 | 18.1 | 8.1 | 0.099 | 1.09 |
| Inventive Examples | 0.05 | 0.038 | 0.4 | 1.0 | 18 | 9.2 | 0.096 | 0.102 |
| Inventive Example6 | 0.051 | 0.041 | 0.4 | 3.62 | 18.1 | 8.1 | 0.104 | 0.102 |
| Inventive Example7 | 0.052 | 0.041 | 0.4 | 4.5 | 18.1 | 8.09 | 0.097 | 0.1 |
| Comparative Example1 | 0.047 | 0.089 | 0.41 | 0.99 | 18.1 | 8.13 | 0.099 | 0.104 |
| Comparative Example2 | 0.054 | 0.108 | 0.4 | 0.97 | 18.2 | 8.12 | 0.103 | 0.1 |
| Comparative Example3 | 0.054 | 0.108 | 0.4 | 0.97 | 18.2 | 8.12 | 0.103 | 0.1 |
| Comparative Example4 | 0.048 | 0.042 | 0.4 | 2.13 | 18.2 | 8.04 | 0.099 | 0.11 |
| Comparative Example5 | 0.048 | 0.042 | 0.4 | 2.13 | 18.2 | 8.04 | 0.099 | 0.11 |
| Comparative Example6 | 0.051 | 0.041 | 0.4 | 3.62 | 18.1 | 8.1 | 0.104 | 0.103 |
| Comparative Example7 | 0.052 | 0.041 | 0.4 | 4.5 | 18.1 | 8.09 | 0.097 | 0.101 |

TABLE 1-continued

| | C | N | Si | Mn | Cr | Ni | Mo | Cu |
|---|---|---|---|---|---|---|---|---|
| Comparative Example8 | 0.048 | 0.054 | 0.37 | 1.01 | 18.2 | 8.11 | 0.103 | 0.101 |
| Comparative Example9 | 0.048 | 0.054 | 0.37 | 1.01 | 18.2 | 8.11 | 0.103 | 0.104 |
| Comparative Example10 | 0.047 | 0.089 | 0.41 | 0.99 | 18.1 | 8.13 | 0.099 | 0.1 |
| Comparative Example11 | 0.02 | 0.04 | 0.3 | 1.5 | 18.3 | 8.3 | 0.1 | 1.2 |
| Comparative Example12 | 0.06 | 0.025 | 0.4 | 0.8 | 18 | 8.1 | 0.3 | 0.8 |
| Comparative Example13 | 0.048 | 0.041 | 0.42 | 1.0 | 17.9 | 8.07 | 0.1 | 0.091 |
| Comparative Example14 | 0.048 | 0.041 | 0.42 | 1.0 | 17.9 | 8.07 | 0.1 | 0.091 |
| Comparative Example15 | 0.05 | 0.039 | 0.42 | 1.0 | 18.2 | 8.26 | 0.102 | 0.45 |
| Comparative Example16 | 0.05 | 0.039 | 0.42 | 1.0 | 18.2 | 8.26 | 0.102 | 0.45 |
| Comparative Example17 | 0.056 | 0.04 | 0.39 | 1.01 | 18.1 | 8.07 | 0.101 | 0.82 |
| Comparative Example18 | 0.049 | 0.036 | 0.39 | 1.06 | 18.1 | 8.1 | 0.099 | 1.09 |
| Comparative Example19 | 0.053 | 0.038 | 0.4 | 1.02 | 18 | 8.4 | 0.102 | 0.1 |
| Comparative Example20 | 0.053 | 0.038 | 0.4 | 1.02 | 18 | 8.4 | 0.102 | 0.1 |
| Comparative Example21 | 0.05 | 0.041 | 0.4 | 0.95 | 17.9 | 8.72 | 0.101 | 0.1 |
| Comparative Example22 | 0.05 | 0.041 | 0.4 | 0.95 | 17.9 | 8.72 | 0.101 | 0.1 |
| Comparative Example23 | 0.05 | 0.038 | 0.4 | 1.0 | 18 | 9.2 | 0.096 | 0.102 |

Using the Inventive Example and Comparative Example steel grades shown in Table 1, as shown in FIG. 1, the 1st to 5th steps of pipe expansion and 6th step of curling were performed.

TABLE 2

| | C + N | Md30 (° C.) | Grain Size (μm) | Md30 × Grain Size | work-hardening exponent n (@ true strain 0.3~0.4) | Number of cracks in the circumferential direction of the curling part |
|---|---|---|---|---|---|---|
| Inventive Example1 | 0.06 | −19.7 | 45 | −886.1 | 0.45~0.5 | 0 |
| Inventive Example2 | 0.06 | −19.7 | 72 | −1417.7 | 0.45~0.5 | 0 |
| Inventive Example3 | 0.10 | −12.8 | 42 | −536.3 | 0.45~0.5 | 0 |
| Inventive Example4 | 0.09 | −16.8 | 52 | −871.3 | 0.45~0.5 | 0 |
| Inventive Examples | 0.09 | −19.5 | 59 | −1147.8 | 0.45~0.5 | 0 |
| Inventive Example6 | 0.09 | −12.1 | 45 | −545.1 | 0.45~0.5 | 0 |
| Inventive Example7 | 0.09 | −19.2 | 46 | −884.4 | 0.45~0.5 | 0 |
| Comparative Example1 | 0.14 | −12.1 | 55 | −665.2 | 0.40~0.45 | 2 |
| Comparative Example2 | 0.16 | −25.0 | 25 | −625.2 | 0.30~0.40 | 3 |
| Comparative Example3 | 0.16 | −25.0 | 47 | −1175.3 | 0.40~0.45 | 4 |
| Comparative Example4 | 0.09 | 1.0 | 27 | 26.1 | 0.50~0.55 | 4 |
| Comparative Examples | 0.09 | 1.0 | 68 | 65.7 | 0.50~0.65 | 4 |
| Comparative Example6 | 0.09 | −12.1 | 25 | −302.8 | 0.30~0.45 | 1 |
| Comparative Example7 | 0.09 | −19.2 | 22 | −423.0 | 0.30~0.40 | 1 |

TABLE 2-continued

| | C + N | Md30 (° C.) | Grain Size (μm) | Md30 × Grain Size | work-hardening exponent n (@ true strain 0.3~0.4) | Number of cracks in the circumferential direction of the curling part |
|---|---|---|---|---|---|---|
| Comparative Example8 | 0.10 | 3.1 | 20 | 61.4 | 0.50~0.55 | 4 |
| Comparative Example9 | 0.10 | 3.1 | 48 | 147.4 | 0.50~0.65 | 4 |
| Comparative Example10 | 0.14 | −12.1 | 23 | −278.2 | 0.30~0.40 | 1 |
| Comparative Example11 | 0.06 | −19.7 | 21 | −413.5 | 0.30~0.40 | 1 |
| Comparative Example12 | 0.09 | −8.7 | 23 | −199.6 | 0.40~0.45 | 2 |
| Comparative Example13 | 0.09 | 14.2 | 21 | 297.5 | 0.50~0.70 | 4 |
| Comparative Example14 | 0.09 | 14.2 | 47 | 665.9 | 0.50~0.70 | 4 |
| Comparative Example15 | 0.09 | −5.9 | 20 | −118.0 | 0.40~0.50 | 2 |
| Comparative Example16 | 0.09 | −5.9 | 38 | −224.2 | 0.40~0.55 | 2 |
| Comparative Example17 | 0.10 | −12.8 | 24 | −306.5 | 0.40~0.45 | 2 |
| Comparative Example18 | 0.09 | −16.8 | 25 | −418.9 | 0.40~0.45 | 1 |
| Comparative Example19 | 0.09 | 2.0 | 22 | 44.6 | 0.50~0.55 | 4 |
| Comparative Example20 | 0.09 | 2.0 | 55 | 111.6 | 0.50~0.65 | 4 |
| Comparative Example21 | 0.09 | −5.2 | 24 | −125.7 | 0.40~0.50 | 3 |
| Comparative Example22 | 0.09 | −5.2 | 45 | −235.7 | 0.40~0.55 | 2 |
| Comparative Example23 | 0.09 | −19.5 | 22 | −428.0 | 0.30~0.40 | 1 |

Referring to Tables 1 and 2, when C+N according to the present disclosure is in the range of 0.06 to 0.1%, and the value of Md30 (° C.)×Grain Size (μm) is less than −500, it was found that no cracks occurred in the circumferential direction in the curling part at the end of the fuel injection pipe even after the 5th step of expansion processing and 6th step of curling.

FIG. 2 is a graph showing the correlation of the number of cracks in the circumferential direction of a fuel injection pipe according to Md30 (° C.)×grain size (μm). The correlation between Md30 (° C.)×Grain Size (μm) and the number of cracks in the circumferential direction at the end of the tube shows a very strong correlation as shown in FIG. 2. When the Md30 (° C.)×Grain Size (μm) parameter value is in the range of −500 to 0, in the circumferential direction, processing cracks or aging cracks occurred in as many as 4 places and at least 1 place. In addition, it was confirmed that the number of cracks in the circumferential direction increased to 5 or more when the Md30 (° C.)×Grain Size (μm) parameter value showed a + value in the range of 0 to 500.

Inventive Examples 1 to 7 manage the Md30 value at −10° C. or less and manufacture the average grain size above of 45 μm or more and control the Md30(° C.)×Grain Size (μm) parameter to be −500 or less. In the uniaxial tensile test, the work-hardening exponent (n) in the range of 0.3 to 0.4 of the true strain was in the range of 0.45 to 0.5, so cracks do not occur during tube expansion processing and curling processing.

Comparative Example 1, 2, 3, and 10 showed that the C+N range exceeded 0.1% and the Md30 value was as low as −10° C. or less, but the work-hardening exponent (n) in the range of true strain 0.3~0.4 was also as low as 0.45 or less It appeared as low as below, so cracks occurred after tube expansion processing and curling processing.

Comparative Example 6, 7, 11, 12, 15, 16, 17, 18, 21, 23 have low Md30 values −5° C. or less. However, due to the fine grain size of less than 45 μm, since the work-hardening exponent (n) of 0.45 or less was included in the true strain 0.3~0.4 section, cracks occurred after the tube expansion process and curling process.

Comparative Example 4, 5, 8, 9, 13, 14, 19, 20 had a work-hardening exponent (n) of 0.5 or more in the true strain 0.3~0.4 due to the high Md30 value of 0° C. or higher. Accordingly, a lot of strain-induced martensite was generated after tube expansion processing and curling processing, and thus cracks due to aging crack occurred.

Limited Drawing Ratio and Expansion Rate Evaluation

The aging crack limited drawing ratio and hole expansion rate (HER) were measured for some of the Inventive Example and Comparative Example steel types listed in Table 1. The aging crack limited drawing ratio is a limited drawing ratio in which aging crack does not occur, and refers to the ratio (D/D') of the maximum diameter (D) and the punch diameter (D') of a material during drawing processing.

FIG. 3 is a schematic diagram of a method for measuring a hole expansion rate. The hole expansion rate was measured according to Equation (2) described above using the evaluation method of FIG. 3.

TABLE 3

| | Md30 (° C.) | Grain Size (μm) | Md30 × Grain Size | aging crack limited drawing ratio | hole expansion rate (HER, %) |
|---|---|---|---|---|---|
| Inventive Example 1 | −19.69 | 45 | −886.05 | 3.33 | 75.3 |
| Inventive Example 2 | −19.69 | 72 | −1417.68 | 3.54 | 77.0 |
| Inventive Example 3 | −12.7695 | 42 | −536.319 | 3.17 | 75.3 |
| Inventive Example 4 | −16.7555 | 52 | −871.286 | 3.17 | 75.3 |
| Inventive Example 5 | −19.454 | 59 | −1147.786 | 3.17 | 75.3 |
| Inventive Example 6 | −12.113 | 45 | −545.085 | 2.97 | 72.0 |
| Inventive Example 7 | −19.2255 | 46 | −884.373 | 3.33 | 75.3 |
| Comparative Example 1 | −12.0945 | 55 | −665.1975 | 2.21 | 62.1 |
| Comparative Example 2 | −25.0065 | 25 | −625.1625 | 2.34 | 65.2 |
| Comparative Example 3 | −25.0065 | 47 | −1175.3055 | 2.50 | 66.5 |
| Comparative Example 4 | 0.9655 | 27 | 26.0685 | 2.21 | 72.0 |
| Comparative Example 5 | 0.9655 | 68 | 65.654 | 2.21 | 77.0 |
| Comparative Example 6 | −12.113 | 25 | −302.825 | 2.97 | 62.1 |
| Comparative Example 7 | −19.2255 | 22 | −422.961 | 2.97 | 62.1 |
| Comparative Example 8 | 3.0715 | 20 | 61.43 | 2.21 | 72.6 |
| Comparative Example 9 | 3.0715 | 48 | 147.432 | 1.97 | 75.3 |
| Comparative Example 12 | −8.68 | 23 | −199.64 | 2.50 | 65.2 |
| Comparative Example 14 | 14.169 | 47 | 665.943 | 1.91 | 77.0 |
| Comparative Example 15 | −5.899 | 20 | −117.98 | 2.21 | 65.2 |
| Comparative Example 16 | −5.899 | 38 | −224.162 | 2.50 | 72.0 |
| Comparative Example 19 | 2.029 | 22 | 44.638 | 2.21 | 69.1 |
| Comparative Example 20 | 2.029 | 55 | 111.595 | 2.50 | 75.3 |
| Comparative Example 23 | −19.454 | 22 | −427.988 | 3.17 | 65.1 |

FIG. 4 is a graph showing an aging crack limited drawing ratio and a hole expansion rate range according to an embodiment of the present disclosure. In order to secure moldability that does not cause cracks even after the five-step expansion processing and curling part processing of the fuel injection pipe tube, sufficient hole expansion and aging crack resistance of the material are required. By managing the Md30 value at −10° C. or less and manufacturing an average grain size of 45 μm or more and controlling the Md30(° C.)×Grain Size m) parameter value to be −500 or less, Inventive Examples 1 to 7 simultaneously satisfied an aging crack limited drawing ratio of 2.97 or higher and a hole expansion rate (HER) of 72% or higher. It can be seen that the Inventive Examples in the rectangular box of FIG. 4 satisfy both the aging crack limited drawing ratio and the hole expansion rate of the present disclosure.

Comparative Examples 2, 6, 7, 12, 15, and 23 had low Md30 values of −5° C. or less, but exhibited expansion ratio of 70% or less due to the fine grain size of 30 μm or less.

Comparative Examples 4, 5, 8, 9, 14, 19, and 20 showed aging crack limited drawing ratios of less than 2.97 due to the high Md30 value of 0° C. or higher.

As described above, although exemplary embodiments of the present disclosure have been described, the present disclosure is not limited thereto, and those of ordinary skill in the art will appreciate that various changes and modifications are possible without departing from the concept and scope of the following claims.

The invention claimed is:

1. An austenitic stainless steel comprising, in percent (%) by weight of the entire composition, C: 0.01 to 0.04%, Si: 0.1 to 1.0%, Mn: 0.1 to 2.0%, Cr: 16 to 20%, Ni: 6 to 10%, Cu: 0.1 to 2.0%, Mo: 0.2% or less, N: 0.035 to 0.07%, and the remainder of iron (Fe) and other inevitable impurities, wherein the C+N satisfies 0.06 to 0.1%, wherein an Md30 value in equation (1) is −10° C. or less, and an average grain size is 45 μm or more, $$Md30=551-462*(C+N)-9.2*Si-8.1*Mn-13.7*Cr-29*(Ni+Cu)-18.5*Mo \quad (1)$$

where, C, N, Si, Mn, Cr, Ni, Cu, and Mo represent the content, % by weight, of each element, wherein a product of the Md30 (° C.) value represented by the equation (1) and the average grain size (μm) satisfies less than −500, wherein a work-hardening exponent n value in a range of true strain 0.3 to 0.4 satisfies the range of 0.45 to 0.5, wherein an aging crack limited drawing ratio of the stainless steel is 2.97 or more, and wherein a hole expansion rate (HER) represented by equation (2) is 72% or more $$HER=(D_h-D_0)/D_0\times 100 \quad (2)$$

where $D_h$ is an inner diameter after fracture and $D_0$ is an initial inner diameter.

* * * * *